US007433645B2

(12) United States Patent
Aiyama

(10) Patent No.: US 7,433,645 B2
(45) Date of Patent: Oct. 7, 2008

(54) IMAGE FORMING APPARATUS AND IMAGE FORMING METHOD

(75) Inventor: Kenji Aiyama, Cupertino, CA (US)

(73) Assignee: Canon Kabushiki Kaisha, Tokyo (JP)

( * ) Notice: Subject to any disclaimer, the term of this patent is extended or adjusted under 35 U.S.C. 154(b) by 469 days.

(21) Appl. No.: 11/206,049

(22) Filed: Aug. 18, 2005

(65) Prior Publication Data

US 2006/0045547 A1 Mar. 2, 2006

(30) Foreign Application Priority Data

Aug. 24, 2004 (JP) ..... 2004-244130

(51) Int. Cl.
*G03G 15/00* (2006.01)

(52) U.S. Cl. ..... 399/391; 399/389

(58) Field of Classification Search ..... 399/391, 399/389, 388, 23, 21, 18, 16
See application file for complete search history.

(56) References Cited

U.S. PATENT DOCUMENTS

| | | | | |
|---|---|---|---|---|
| 5,130,757 | A * | 7/1992 | Ito | 399/14 |
| 5,168,316 | A * | 12/1992 | Hino et al. | 399/23 |
| 5,323,220 | A * | 6/1994 | Yasuda | 399/391 |
| 5,393,043 | A * | 2/1995 | Nitta | 271/9.06 |
| 6,010,261 | A * | 1/2000 | Maekawa | 400/605 |
| 6,259,468 | B1 * | 7/2001 | Higuchi | 347/262 |
| 6,283,653 | B1 * | 9/2001 | Higuchi | 400/582 |
| 6,791,703 | B1 | 9/2004 | Maeda et al. | 358/1.15 |
| 7,303,187 | B2 * | 12/2007 | Shiho et al. | 271/9.01 |
| 2004/0125398 | A1 | 7/2004 | Aiyama | 358/1.14 |
| 2005/0141006 | A1 | 6/2005 | Aiyama | 358/1.13 |

FOREIGN PATENT DOCUMENTS

| | | |
|---|---|---|
| JP | 6219602 | 8/1994 |
| JP | 8188280 | 7/1996 |
| JP | 9-301561 | 11/1997 |
| JP | 11065370 | 3/1999 |
| JP | 2002019212 | 1/2002 |
| JP | 2003192155 | 7/2003 |

* cited by examiner

*Primary Examiner*—Anthony H. Nguyen
(74) *Attorney, Agent, or Firm*—Fitzpatrick, Cella, Harper & Scinto

(57) ABSTRACT

An image forming apparatus determining a paper feed source having a possibility of feeding paper sheets in executing a printing job in accordance with contents of the printing job and detecting characteristics of a paper sheet fed from the paper feed source for executes printing processing of a printing job, wherein the printing of the printing job is performed by feeding at least one paper sheet from each of all the paper feed sources having a possibility of paper feed and, if the detected characteristics of the paper sheet do not meet the characteristics of a paper sheet stored in a memory, printing processing is temporarily or completely stopped.

11 Claims, 6 Drawing Sheets

FIG. 3

| | STACKABLE NUMBER OF PAPER SHEETS | PAPER SIZE |
|---|---|---|
| PAPER FEED CASSETTE 4 | 1000 | A4 |
| PAPER FEED CASSETTE 5 | 1000 | B4 |
| PAPER FEED CASSETTE 6 | 500 | A4 |
| PAPER FEED CASSETTE 7 | 500 | A3 |
| PAPER FEED DECK 8 | 2000 | A4 |

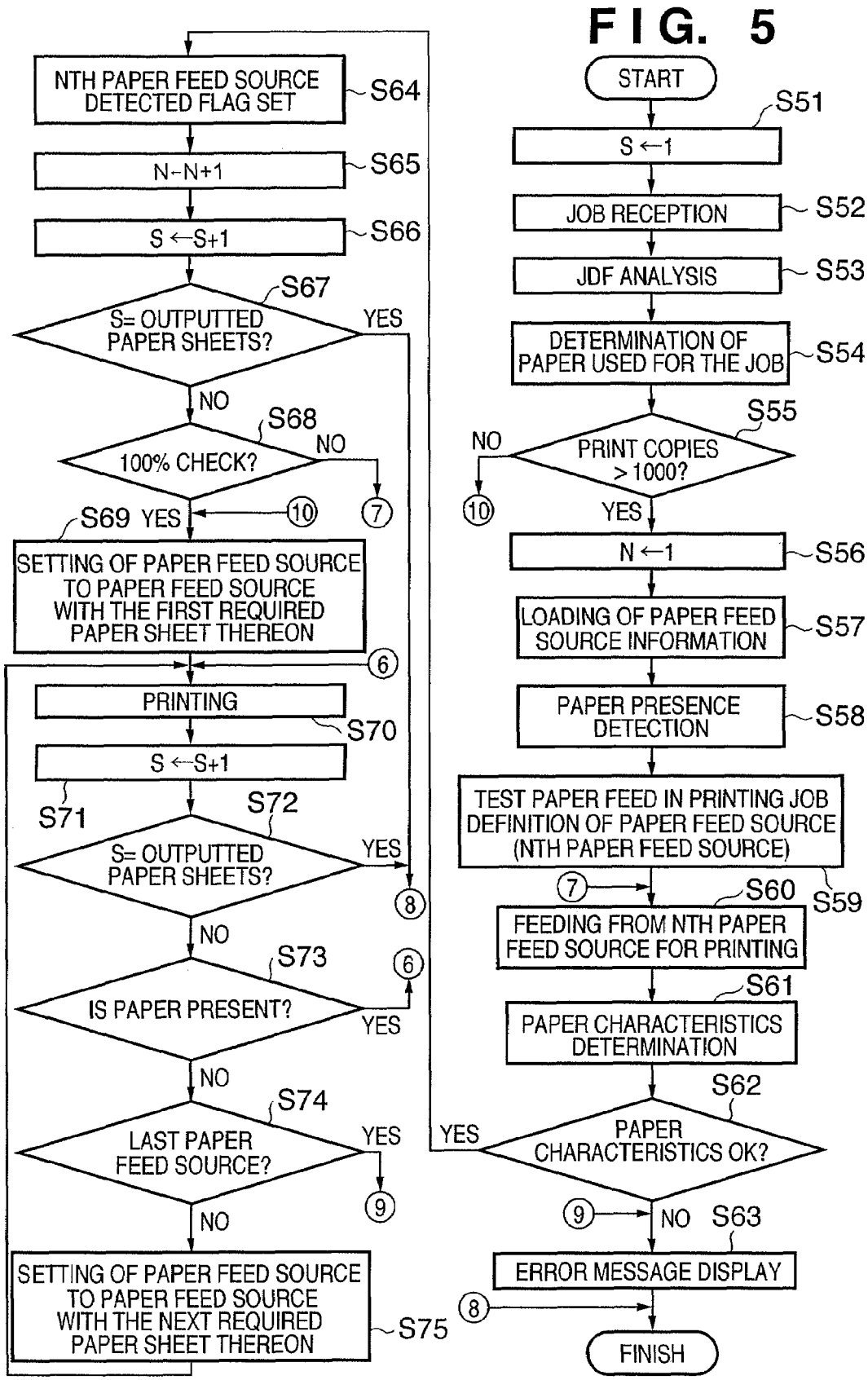
FIG. 5
START
S51
S ←1
JOB RECEPTION
S52
JDF ANALYSIS
S53
DETERMINATION OF PAPER USED FOR THE JOB
S54
S55
PRINT COPIES > 1000?
NO
YES
N ←1
S56
LOADING OF PAPER FEED SOURCE INFORMATION
S57
PAPER PRESENCE DETECTION
S58
TEST PAPER FEED IN PRINTING JOB DEFINITION OF PAPER FEED SOURCE (NTH PAPER FEED SOURCE)
S59
S60
FEEDING FROM NTH PAPER FEED SOURCE FOR PRINTING
S61
PAPER CHARACTERISTICS DETERMINATION
S62
PAPER CHARACTERISTICS OK?
S63
ERROR MESSAGE DISPLAY
FINISH
NTH PAPER FEED SOURCE DETECTED FLAG SET
S64
N-N+1
S65
S ←S+1
S66
S67
S= OUTPUTTED PAPER SHEETS?
S68
100% CHECK?
S69
SETTING OF PAPER FEED SOURCE TO PAPER FEED SOURCE WITH THE FIRST REQUIRED PAPER SHEET THEREON
PRINTING
S70
S71
S72
S73
IS PAPER PRESENT?
S74
LAST PAPER FEED SOURCE?
SETTING OF PAPER FEED SOURCE TO PAPER FEED SOURCE WITH THE NEXT REQUIRED PAPER SHEET THEREON
S75

FIG. 6

| | SIZE | COLOR | STACKED PAPER SHEETS | DETECTED ALREADY |
|---|---|---|---|---|
| PAPER FEED CASSETTE 4 | A4 | WHITE | 1000 | Y |
| PAPER FEED CASSETTE 5 | B4 | WHITE | 1000 | Y |
| PAPER FEED CASSETTE 6 | A4 | WHITE | 500 | N |
| PAPER FEED CASSETTE 7 | A4 | BLUE | 500 | Y |
| PAPER FEED DECK 8 | A4 | WHITE | 2000 | N |

IMAGE FORMING APPARATUS AND IMAGE FORMING METHOD

FIELD OF THE INVENTION

The invention relates to an image forming apparatus for developing images on a paper sheet.

BACKGROUND OF THE INVENTION

Many of printed materials had been printed using a printing plate like offset printing, however, with recent trend toward better pictures and speeding-up of electrophotography and ink-jet printing, printing traders which use a electrophotographic printer or an ink-jet printer for a relatively small volume of printing have been increased in number.

Such an electrophotographic printer is provided with a plurality of paper feed sources usually loaded with printing paper, especially, different sizes of printing paper. Therefore, by selecting a paper feed source in accordance with a paper size to be printed, printing can be printed on different sizes of paper without need for replacing stacked paper.

In executing printing jobs having a large number of print copies or pages, the same size of paper sheets used for printing are respectively stacked on a plurality of paper feed sources in advance. If no paper sheets exist on the paper feed source which first starts paper feeding, a paper feed source is shifted to the next paper feed source to continue printing. Thus, even if printing is required by more than the number of paper sheets stackable on one paper feed source, continuous printing can be performed without any interruption of printing due to paper supply.

As disclosed in the following Patent Document 1, for example, if it is detected that no paper sheets exist on a paper feed source during continuous printing, printing operation is interrupted, paper sheet sizes stacked on all paper feed sources provided in a copying machine are detected, and the paper feed source stacking the paper sheets of the size being used before the interruption is searched, thus enabling restart paper feeding with the searched paper feed source. [Patent Document 1] Japanese Patent Laid-Open No. 9-301561

In a prior art as disclosed in Patent Document 1, however, when there is a printing job having a great many print copies and shifting of a paper feed source occurs, paper feeding is not performed from the next paper feed source until the first paper feed source has no paper sheets thereon, therefore only after all the paper sheets on the first paper feed source has been completely fed, it cannot be confirmed whether or not the same paper sheets are stacked on the next paper feed source and whether or not paper jam will occur.

For example, in the case where a printer equipped with three paper feed sources, each of which is capable of stacking 1,000 paper sheets, executes a printing job of 2,500 paper copies, the printer feeds the first 1000 paper sheets from the first paper feed source and shifts the first paper feed to the second one to continue printing. However, the printer cannot determine whether or not the paper sheets are of the same size as that before the shifting until the shifting has been completed.

If the paper sheets are not of the same size, the printer must discontinue the printing operation and, even if stacking 2,500 paper sheets or more, the printer has a possibility of discontinuing printing operation in the course of the printing operation.

If the paper sheets are different from the paper sheets to be expected immediately after the printing job is commenced, there is a high possibility of an operator standing nearby an image forming apparatus, and the operator can replace the paper sheets, so that there are few cases where execution of the printing job is interrupted over a long time.

However, if the paper feed source is shifted after a printing job is started, no paper sheets are on a particular paper feed source (for example, after 1,000 print copies are printed) and paper sheets on the working paper feed source after the shifting are different from desired paper sheets, there is a low possibility of an operator standing nearby the image forming apparatus because the printing job is under execution, so that there is a possibility of the execution of the printing job being interrupted over a long time.

Paper sheets are generally apt to have paper jam most frequently immediately when the paper sheets have been first fed from a paper feed source after having been stacked. Therefore, if no paper jam occurs at the first paper feeding, there is a low possibility of occurrence of the subsequent paper jam. Therefore, there if a high possibility of occurrence of paper jam when the first paper feed source is shifted to the second paper feed source.

In the event of occurrence of such a condition, printing stops, therefore, even if three paper feed sources capable of stacking a total of 3,000 paper sheets are provided, it is necessary to check whether or not the paper sheets are properly printed continuously even after a paper feed source is shifted in the course of printing.

SUMMARY OF THE INVENTION

In view of the foregoing, it is an aspect of the present invention to provide an image forming apparatus capable of avoiding interruption of execution of an image forming job for a long time by previously determining the characteristics of paper sheets fed from a plurality of paper stacking unit loaded with paper sheets to be used for the image forming job before there exist no paper sheets stacked on particular paper stacking unit even if an image forming job consisting of a plurality of pages is executed by shifting the plurality of paper stacking unit.

According to one aspect of the present invention, an image forming apparatus comprises: generating unit adapted to generate an image forming job including image data corresponding to a plurality of pages; image forming unit adapted to form an image on paper based on the image data included in the image forming job; a plurality of paper feeding units capable of feeding paper used for image formation with the image forming unit; designating unit adapted to designate two or more paper feeding units used for the image forming job from among the plurality of paper feeding units; paper attribute detecting unit adapted to detect the attribute of paper conveyed on a paper feed path fed from the plurality of paper feeding unit; determining unit adapted to determine whether or not the attribute of paper fed from the paper feeding unit designated by the designating unit meets the paper attribute information included in the image forming job based on the detection result of the paper attribute detecting unit; and control unit adapted to control the plurality of designated paper feeding units to feed at least one paper sheet so as to perform determination by the determining unit for paper fed from the plurality of designated paper feeding units before execution of the image forming job.

According to another aspect of the present invention, an image forming apparatus comprises: generating unit adapted to generate an image forming job including image data corresponding to a plurality of pages; image forming unit adapted to form an image on paper based on the image data included in the image forming job; a plurality of paper feeding units capable of feeding paper used for image formation with the image forming unit; designating unit adapted to designate two or more paper feeding units used for the image forming job from among the plurality of paper feeding units; paper attribute detecting unit adapted to detect the attribute of paper conveyed on a paper feed path fed from the plurality of paper feeding unit; determining unit adapted to determine whether or not the attribute of paper fed from the paper feeding unit designated by the designating unit meets the paper attribute information included in the image forming job based on the detection result of the paper attribute detecting unit; storing unit adapted to store a determination result information which indicates whether or not determination by the determining unit is made for the attribute of paper fed from paper feeding unit designated by the designating unit; and control unit adapted to control the plurality of designated paper feeding units, about which the determination result information is not stored in the storing unit, to feed at least one paper sheet to perform determination by the determining unit for paper fed from the paper feeding units, about which the determination result information is not stored in the storing unit, before execution of the image forming job.

According to further another aspect of the present invention, an image forming method for forming an image on paper based on image data comprises the steps of:

generating step of generating an image forming job including image data corresponding to a plurality of pages;

image forming step of forming an image on paper fed from a plurality of paper feeding unit capable of feeding paper based on the image data included in the image forming job;

designating step of designating two or more paper feeding units used for the image forming job from among the plurality of paper feeding units;

determining step of determining whether or not the attribute of paper fed on a paper feed path from a paper feeding unit designated in the designating step meet the paper attribute information included in the image forming job based on the detection result of a detecting section for detecting the attribute of paper conveyed on the paper feed path; and control step of controlling the plurality of designated paper feeding units to feed at least one paper sheet so as to perform determination by the determining step for paper fed from the plurality of designated paper feeding units before execution of the image forming job.

According to still another aspect of the present invention, an image forming method for forming an image on paper based on image data comprises the steps of:

generating step of generating an image forming job including image data corresponding to a plurality of pages;

image forming step of forming an image on paper fed from a plurality of paper feeding unit capable of feeding paper based on the image data included in the image forming job;

designating step of designating two of more paper feeding units used for the image forming job from among the plurality of paper feeding units;

determining step of determining whether or not the attribute of paper fed on a paper feed path from paper feeding unit designated in the designating step meet the paper attribute information included in the image forming job based on the detection result of a detecting section for detecting the attribute of paper conveyed on the paper feed path; storing step of storing, in storing unit, a determination result information which indicates whether or not determination in the determining step is made for the attribute of paper fed from the paper feeding unit designated in the designating step; and controlling step of controlling the plurality of designated paper feeding units, about which the determination result information is not stored in the storing unit, to feed at least one paper sheet to perform the determination step for paper fed from the paper feeding units, about which the determination result information is not stored in the storing unit, before execution of the image forming job.

The above and other objects, features and advantages of the present invention will be apparent from the following detailed descriptions of the preferred embodiments of the invention in conjunction with the accompanying drawings.

BRIEF DESCRIPTION OF THE DRAWINGS

FIG. 3 is a view illustrating an example of a stacking state of each paper feed source according to the first embodiment;

FIG. 5 is a flow chart for explaining the operation control of an image forming apparatus according to the second embodiment; and FIG. 6 is a view illustrating an example of a stacking state of each paper feed source according to the second embodiment.

DETAILED DESCRIPTION OF THE PREFERRED EMBODIMENTS

Figure 1:
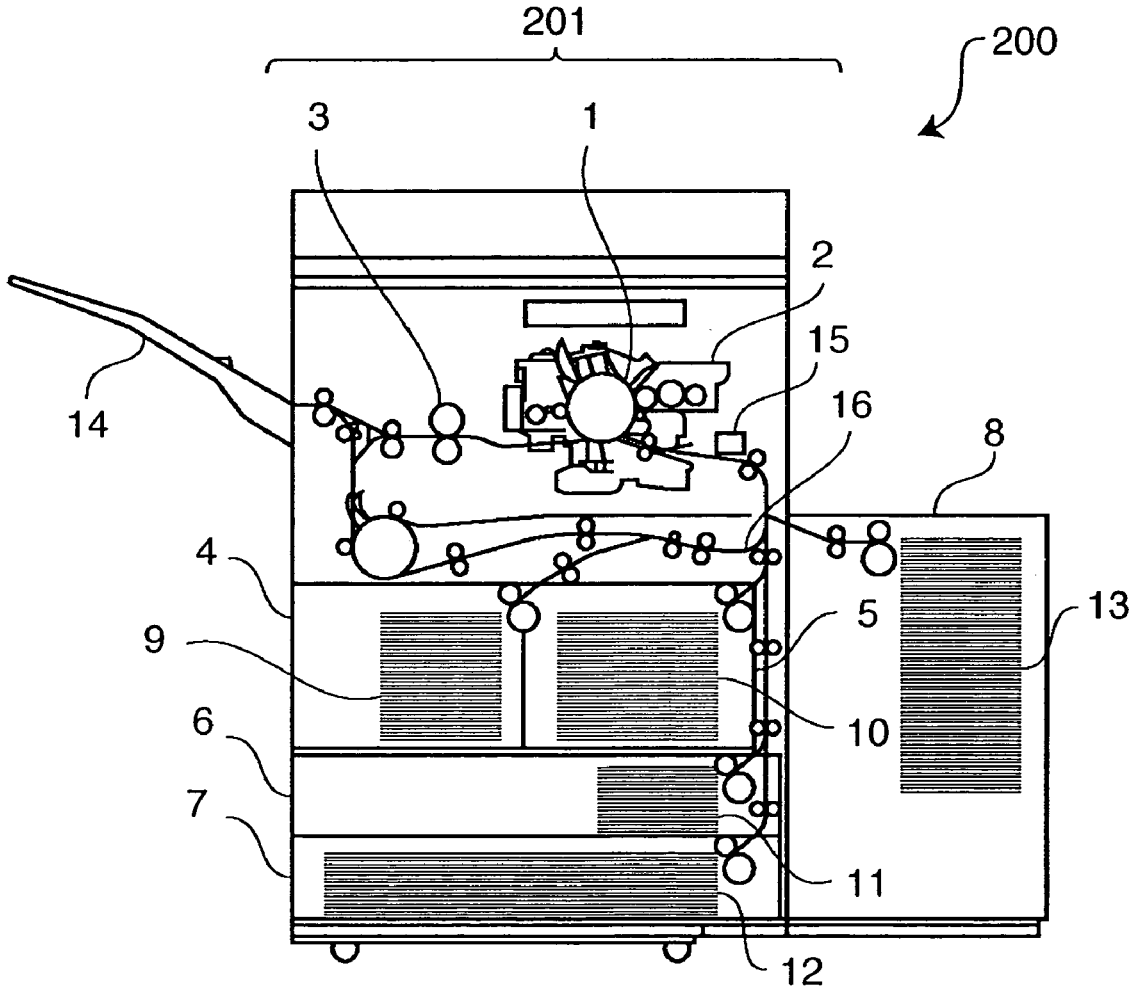
FIG. 1 is a view illustrating an image forming apparatus according to the present invention.

Referring now to the drawings, each embodiment will be described in detail.

First Embodiment

FIG. 1 is a view illustrating an image forming apparatus 200 according to the first embodiment.

In FIG. 1, a reference numeral 1 is a laser unit for developing electrostatic latent images corresponding to image data inputted from an external device on a photoconductive drum by converting the image data into blink of laser beam and scanning the laser beam to form images on a paper sheet based on the image data. A reference numeral 2 is a developing unit for performing development by absorbing toner to the electrostatic latent images on the photoconductive drum formed by the laser beam from the laser unit 1. A reference numeral 3 is a fixing unit for fixing a toner image transferred onto a paper sheet from the photoconductive drum by means of heating or pressure. Thereby, images can be formed on a paper sheet by an image forming section 201 equipped with the respective units 1, 2 and 3.

Reference numerals 4 to 7 are paper feed cassettes as paper stacking means which stacks a plurality of paper sheets and feeds paper sheets stacked before printing one by one. A reference numeral 8 is an external paper feed deck which is capable of stacking a large number of paper sheets and serving as paper feed means of feeding the paper sheets stacked before printing. Reference numerals 9 to 13 are paper sheets, and a reference numeral 14 is a paper discharge tray for stacking printed (image-formed) paper sheets. A reference numeral 15 is a paper size sensor for detecting the width (a length in the orthogonal direction to feed direction) and the length of (a length in the feed direction) of each of paper sheets fed from the paper feed cassettes 4 to 7 or the paper feed deck 8.

Each of the paper feed cassettes 4 to 7 and the paper feed deck 8 has a paper guide adjustable in accordance with the size of paper sheets, which is not provided with such detection means of detecting the size of stacked paper sheets without paper feed.

Figure 2:
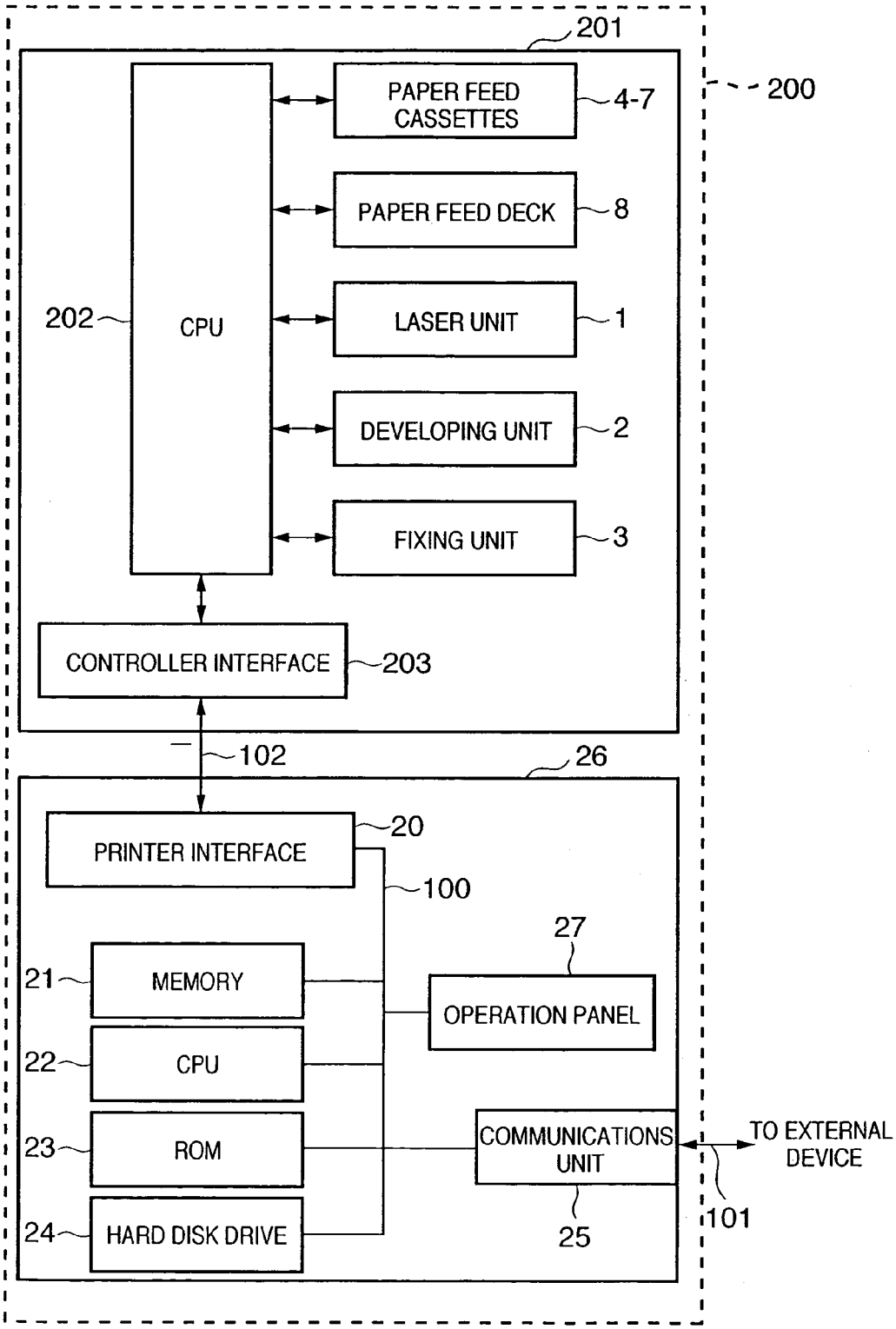
FIG. 2 is a block diagram illustrating a configuration of an image forming apparatus according to the present invention.

FIG. 2 is a block diagram illustrating a configuration of the image forming apparatus 200 according to the first embodiment.

In FIG. 2, a reference numeral 20 is a printer interface which receives a printing job (an image forming job) including image data for a plurality of pages from an external device through a network cable 101 described later, generates image data from the received printing job and transmits the image data to the image forming section 201. A reference numeral 21 is a memory for temporarily storing image data, and a reference numeral 22 is a CPU for executing a program relating to image processing and the like. A reference numeral 23 is a ROM for storing a program to be executed, and a reference numeral 24 is a hard disk drive for temporarily storing a printing job. A reference numeral 25 is a communications unit for receiving a printing job from an external device, and a reference numeral 26 is a printer controller. Moreover, a reference numeral 27 is an operation panel serving as a user interface for conducting various types of settings from an operator of the image forming apparatus 200, instruction for execution of an image forming job to be executed with the image forming apparatus 200 and the like, and can receive an input from an operator and display various types of warnings and the like for the operator. A reference numeral 100 is an internal bus for a data transferring path for connecting the printer interface 20, the memory 21, the CPU 22, the ROM 23, the hard disk drive 24 and the communications unit 25 to each other. A reference numeral 101 is a network cable for a communicating path for receiving a printing job from an external device. A reference numeral 102 is a printer interface cable which connects the printer controller 26 with the image forming section 201 and is used for the data transferring path for transferring the image data formed in the printer controller 26.

Furthermore, a reference numeral 202 is a CPU which controls the paper feed cassettes 4 to 7 constituting the image forming section 201, the paper feed deck 8, the laser unit 1, the developing unit 2, the fixing unit 3 and so on, and communicates with the printer controller 26 through the controller interface 203.

FIG. 3 shows that a paper size has been set as information about the characteristics of paper stacked on the paper feed cassettes 4 to 7 and the paper feed deck 8 as paper stacking means. As described above, the paper feed cassettes 4 to 7 and the paper feed deck 8 can stack a plurality of paper sheets, however, cannot automatically detect what size of paper sheets are stacked on each thereof. An operator of the image forming apparatus 200 can set what size of paper sheets have been re-supplied onto each of the paper feed cassettes 4 to 7 and the paper feed deck 8 from an operation panel 27. In FIG. 3, A4 size (210 mm×297 mm) is set as characteristic information for the paper feed cassettes 4, 6 and the paper feed deck 8, B4 size (257 mm×364 mm) is set as characteristic information for the paper feed cassette 5, and A3 size (297 mm×420 mm) is set as characteristic information for the paper feed cassette 7. The paper characteristic information shown in FIG. 3, hereinafter referred to as "paper feed source information", is stored in the memory 21 as a table. Because the operator sets what size of paper sheets have been re-supplied onto each of the paper feed cassettes 4 to 7 and the paper feed deck 8, the size of paper sheets actually re-supplied does not always meet the paper size designated through the operation panel 27 and, if any mistake is made in designation, they do not meet each other. In a flow chart shown in FIG. 4 below, execution of a printing job is prevented from being interrupted as well as possible even if the operator makes a mistake in designations.

An explanation of an ordinary printing flow is given as follows: the printer controller 26, upon reception of printing job data from an external device (not illustrated) through the network cable 101, stores the data in the hard disk drive 24 through communication unit 25 and the internal bus 100.

Next, the printing job data are read out from the hard disk drive 24, and the CPU 22 interprets the printing job data and generates image data in the memory 21. When generation of image data of all pages of the printing job is completed, the image data generated in the memory 21 are transferred to the image forming section 201 through an internal bus 100, a printer interface 20, and the printer interface cable 102.

At the same time, the printer controller determines which of the paper feed cassettes 4 to 7 and the paper feed deck 8 at the paper feed source of the image forming section 201 should first start paper feed, and instructs the image forming section 201 to conduct paper feed from the determined paper feed source.

The printer controller 26 performs control of the image forming section 201 as well such as control of the size of paper to be stacked on a paper feed source.

Next, the operation of the image forming section 201 side is described below. In the image forming apparatus 200 illustrated in FIG. 1, the printer controller 26 controls what size of paper sheets should be stacked on each of the paper feed cassettes 4 to 7 and the paper feed deck 8.

Each of paper sheets is fed from a paper feed source designated by the printer controller 26 and fed on the paper feed path 16. The width and length of the paper sheet fed by the paper size sensor 15 on the way of the paper feed path 16 are measured and fed to the developing unit 2. The printer controller 26 is notified of the measured paper width and length.

When image data are transmitted from the printer controller 26, the image data are inputted into the laser unit 1, so that laser beam blinks according to the image data and laser is scanned.

The laser beam outputted from the laser unit 1 is radiated on the photoconductive drum of the developing unit 2 to form a latent image, so that toner is developed into a latent image, which is transferred onto the fed paper sheet.

The paper sheet transferred with toner is further fed, and heat and pressure are applied to the paper sheet by the fixing unit 3, so that toner is fixed onto the paper sheet, and the paper sheet is discharged to the paper discharge tray 14.

This is the end of explanation of the ordinary printing flow.

Figure 4:
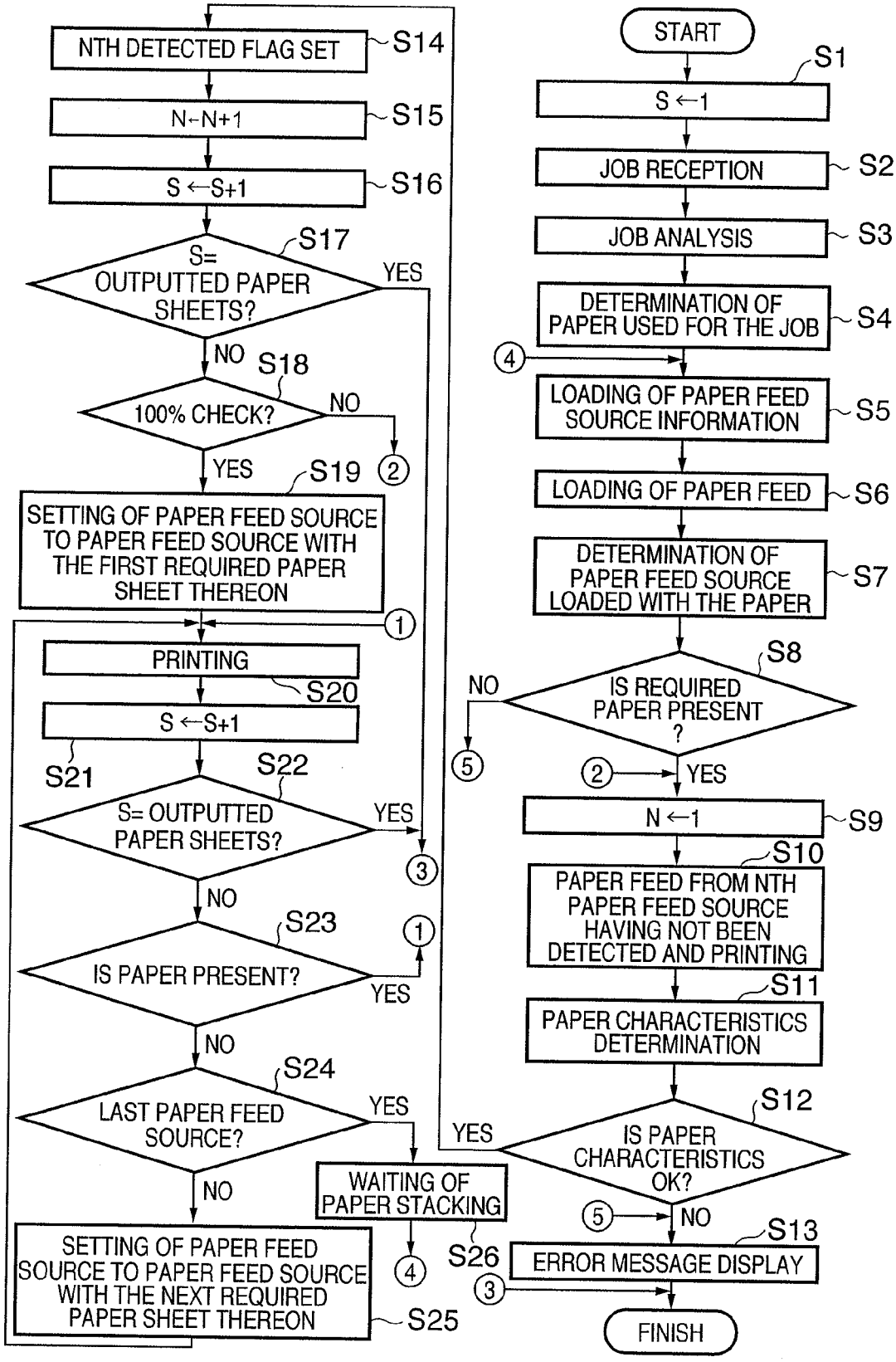
FIG. 4 is a flow chart for explaining the operation control of an image forming apparatus according to the first embodiment.

FIG. 4 is a flow chart for explaining the operation control for selecting a paper feed source of the image forming apparatus 200 according to the first embodiment. A main controller in this flow chart is the CPU 22.

In step S1, a paper counter S of the CPU 22 is set at "1". In step S2, a printing job is received and the received printing job is stored in the hard disk drive 24.

In step 3, the CPU 22 analyzes the printing job stored in the hard disk drive 24 and generates image data based on the analytical data. In step S4, the CPU 22 determines a paper size to be used. The CPU 22, if A4 size is designated in a printing job, determines A4 size as a paper size.

In step S5, the CPU 22 loads paper feed source information for controlling the characteristics of paper sheets to be stacked on each of the paper feed sources, from the memory 21. In step S6, the CPU 22 determines whether or not paper sheets are stacked on each of the paper feed sources.

In step S7, the CPU 22 designates a paper feed source to be loaded with paper sheets of a size determined in step S3 from the results of steps S5 and S6. The CPU 22, for example, in the case where A4 size is designated as a paper size with a printing job, designates the paper feed cassettes 4, 6 and the paper feed deck 8 preset through paper feed information as the paper size used with the printing job being stacked when A4 size paper sheets are stacked from the paper feed cassettes 4 to 7 and the paper feed deck 8. In step S7, the paper feed cassettes 4, 6 and the paper feed deck 8 is taken as being at Nth paper feed source counted by a paper feed source counter N described later, and the paper feed source or paper feed sources not designated in step S7 are not included in a Nth paper feed source described later.

In step S8, the CPU 22 determines whether or not paper sheets of the size used for a printing job are stacked. If the CPU 22 determines that no paper sheets used for a printing job exists, processing moves to step S13 and, if stacking is determined, processing moves to step S9.

In step S9, the paper feed source counter N of the CPU 22 is set at "1", and in step 10, paper sheets are fed from the Nth paper feed source which has not been subjected to paper check before printing.

In step S11, CPU 22 detects the width and length of the paper sheet with the paper size sensor 15 on the paper feed path 16.

In step S12, the CPU 22 determines whether or not the paper size (A4 size for the paper feed cassette 4) of paper feed source information of the Nth paper feed source (ex. paper feed cassette 4) is met.

Specifically, the CPU 22 determines whether or not the width and length of the paper sheet detected by the paper size sensor 15 are within predetermined sizes of paper feed source information, for example, the width and length detected by the paper size sensor 15 are respectively within 10 mm. If the CPU 22 determines them as YES, processing moves to S14 and, if the CPU 22 determines them as NO, the processing moves to S13. In step 13, the CPU 22 controls so as to display warning information indicating that the paper size predetermined as paper feed information and the size of the paper actually fed from a paper feed source are not met each other, on the operation panel 27.

In step 14, the CPU 22 sets a paper check flag for the Nth paper feed source from which a paper sheet is fed in step 10. In step S15, the CPU 22 increments the paper feed source counter N by one and, in step S16, increments the paper counter S by one.

In step S17, the CPU 22 determines whether or not the number of printed paper sheets reaches the number of outputted paper sheets preset at the paper counter S and, if YES, processing is completed. If NO, the processing moves to a step S18.

In step S18, the CPU 22 has not completed paper check, and determines whether or not there exists a paper feed source having possibility of being used for the printing job. If YES, the processing moves to a step S10 and, if NO, the processing moves to a step S19.

In step S19, the CPU 22 sets a paper feed source at a paper feed source loaded with paper sheets required for printing of the first printing job. In step S20, printing processing is executed for a corresponding page.

After the printing processing for the corresponding page, in step S21, the CPU 22 increments the paper counter S by one.

In step S22, the CPU 22 determines whether or not the paper counter S reaches a planned number of outputted paper sheets. If YES, processing is completed and, if NO, the processing moves to a step S23.

In step S23, the CPU 22 determines whether or not a paper feed source being currently used has paper sheets thereon. If the CPU 22 determines it as NO, processing moves to a step S24. If YES, processing returns to a step S20 and printing processing is continued for the next page.

In step S24, CPU 22 determines whether or not a paper feed source being currently used is the last paper feed source loaded with paper sheets to be used for the printing job. If the CPU 22 determines it as YES, processing moves to a step S26 and, if NO, the processing moves to a step S25.

In a step S25, the CPU 22 shifts the paper feed source to a paper feed source loaded with paper sheets required for the next printing job.

In a step S26, the CPU 22 is in a standby state until paper sheets are again stacked.

Controlling the image forming apparatus 200 in accordance with the operation of the above first embodiment yields a technical merit: a possibility that printing is interrupted in the course of printing can be reduced.

For example, with paper sheets of A4 size, a case where a printing job for 3,300 print copies is executed is described below. Each paper feed source has paper sheets of paper size and paper copies shown in FIG. 3 thereon.

Paper feed sources loaded with paper sheets of A4 size are three, and they are the paper feed cassette 4, the paper feed cassette 6 and the paper feed deck 8. The first paper sheet of a printing job is fed from the paper feed deck 8, the second paper sheet is fed from the paper feed cassette 4, and the third paper sheet is fed from the paper feed cassette 6. Each of the paper sheets is detected as being A4 size by the paper size sensor 15, which determines the paper sheets of A4 size can be fed from the three paper feed sources. The fourth to 2,002nd paper sheets are fed from the paper feed deck 8 and finally the paper feed deck 8 has no paper sheets thereon.

Next, the paper feed source is shifted to the paper feed cassette 4, and the 2,003rd to 3,001st paper sheets are fed from the paper feed cassette 4, and the paper feed cassette 4 has no paper sheets thereon.

The paper feed source is shifted to the paper feed cassette 6, and the 3002nd to 3300th paper sheets are fed from the paper feed cassette 6 to complete a printing job.

A case where a paper jam occurs in the paper feed path 16 is described below as an example. When a printing job is started, the second paper sheet is fed from the paper feed cassette 4 and, when a paper jam occurs in the paper feed path 16, only the second paper sheet is printed and it can be confirmed in advance whether a paper jam occurs subsequently.

In an ordinary image forming apparatus unrelated to this embodiment, a trouble such as a paper jam may not occur until the paper feed source has been shifted to the paper feed cassette 4 after the paper feed deck 8 after had had no paper sheets. In other words, such a paper jam can be verified only after 2,000 paper sheets are printed. Therefore, there is high possibility of a printing job being interrupted by a paper jam at every shifting of any of paper feed sources, which makes it difficult to execute the printing job in an unmanned situation. On the contrary, this embodiment can figure out the possibility of jam occurrence in advance, thus enabling to execute the printing job without operator.

In the above embodiment, by shifting a paper feed source loaded with paper sheets used for a printing job in starting the printing job and feeding paper sheets one by one from each of the paper feed sources, it is determined whether or not a paper feed source which may be used for the printing job has paper sheets of a desired size thereon, however, the paper sheets do not always need to be fed one by one, but may be fed by each determined number of paper sheets.

Second Embodiment

Next, an image forming apparatus according to the second embodiment is described. An image forming apparatus and a printer controller to which the second embodiment is applied use the same ones as for the first embodiment. In FIG. 1, a reference numeral 15 is a paper sensor for detecting the width, length and color of a fed paper sheet. In the second embodiment, a printing job a parameter of a job called JDF (Job Definition Format) is transmitted from an external device as a printing job along with information described with XML. The job parameter includes at least "paper size" and "paper color".

Referring first to FIG. 2, there is shown an ordinary printing flow. When the printer controller 26 receives printing job data from an external device (not illustrated) along with JDF through the network cable 101, the printer controller 26 stores the data in the hard disk drive 24 through a communications unit 25 and the internal bus 100.

After a printing job data is read out from the hard disk drive 24, the CPU 22 interprets the printing job data and generates an image data in the memory 21. When generation of image data for all pages in the printing job has been completed, the image data generated in the memory 21 are transferred to the image forming section 201 through the internal bus 100, the printer interface 20, and the printer interface cable 102.

At the same time, the type of paper sheets to be stacked on the paper feed cassettes 4 to 7 and the paper feed deck 8 paper sheets is determined, and an instruction of paper feed from the determined paper feed source is given to the image forming section 201.

The printer controller 26 performs control of the image forming section 201 as well. For example, the printer controller 26 controls the type of paper sheets to be stacked on a specific paper feed source.

Operation of the image forming section 201 is described below.

The image forming apparatus 200 has a configuration as illustrated in FIG. 1 and the printer controller 26 controls the type of paper sheets to be stacked on each of the paper feed cassettes 4 to 7 and the paper feed deck 8.

Paper sheets are fed from a paper feed source designated by the printer controller 26 and conveyed in the paper feed path. The paper sensor 15 provided on the way of the paper feed path measures the width, length and color of the paper sheets before conveyance to the developing unit 2. The measured paper width, length and color are given to the printer controller 26.

When image data are transmitted from the printer controller 26, the image data are inputted into the laser unit 1, and laser beam blinks corresponding to the image data, so that laser is scanned.

The laser beam outputted from the laser unit 1 is irradiated to the photoconductive drum of the developing unit 2 to develop a latent image, so that toner is developed into a latent image and transferred onto the conveyed paper sheet.

The paper sheet transferred with toner is further conveyed, and the fixing unit 3 applies heat and pressure to the paper sheet, so that toner is fixed onto the paper sheet, and the paper sheet is discharged to the paper discharge tray 14.

Referring next to a flow chart shown in FIG. 5, there is described a paper feed source selection control operation. Attention must be directed toward the CPU 22 as a main control body of the operation according to the flow chart shown in FIG. 5 in the same way as the first embodiment.

In step S51, the paper counter S is set to "1". In step S52, a printing job is received and the received printing job is stored in the hard disk drive 24.

In step S53, the JDF, added as a printing job, is analyzed by the CPU 22 stored in the hard disk drive 24 and image data are generated based on the analytical data. In step S54, the paper sheet used for the printing job is discriminated.

In step S55, it is determined whether or not the number of print copies is in excess of 1,000. If YES, processing moves to a step S56 and, if NO, the processing moves to step S69.

In step S56, the paper counter S is set to "1". In step S57, paper feed information for controlling the type of paper sheets stacked on each of the paper feed sources are loaded. In step S58, it is detected (determined) whether or not paper sheets are stacked on each of the paper feed sources.

In step S59, a paper feed source to be subjected to test paper feed for the paper feed in the printing job is determined. This is determined by selecting a paper feed source which has a detection done flag "N" in loaded paper feed source information in step S57, is loaded with the paper sheet determined in step S54, and which is determined to have paper sheets as the results of step S58. This is taken as Nth paper feed source (N: number of a paper feed source to be subjected to test paper feed, counting from zero).

In step S60, a paper sheet is fed from the Nth paper feed source to perform printing.

In step S61, the paper sensor 15 provided in the paper feed path 16 detects the width, length and color of a paper sheet and determines whether or not the paper sheet meets the one in paper feed source information. If YES, processing moves to step S64. If NO, the processing moves to step S63, thus making an error message.

In step S64, the detection done flag for the Nth paper feed source from which a paper sheet is fed in step S60 is set at "Y". In steps S65 and S66, the paper feed source counter N and the paper counter S are respectively incremented by one.

In step S67, It is determined whether or not the paper counter S reaches a planned number of outputted paper sheets. If YES, processing is completed. If NO, the processing moves to a step S68.

In step S68, it is determined whether or not verification of all paper feed sources is completed, that is, whether or not all the detection done flags are at "Y" for all Nth paper feed source. If YES, processing moves to step S69. If NO, the processing moves to step S60.

In step S69, a paper feed source is set at a paper feed source loaded with paper sheets required for printing of the first printing job and, in step S70, printing processing is executed for a corresponding page.

In step S71, the paper counter S is incremented by one.

In step S72, it is determined whether or not the paper counter S reaches a planned number of outputted paper sheets. If YES, processing is completed. If NO, the processing moves to step S73.

In step S73, it is determined whether or not a paper feed source being currently used still has paper sheets thereon. If NO, processing moves to step S74. If YES, the processing moves to step S70 and printing processing is executed for the next page.

In step S74, it is determined whether or not a paper feed source being currently used is the last one loaded with paper sheets to be used for the printing job. If YES, processing moves to step S63 to make an error message. If NO, the processing moves to step S75.

In step S75, a paper feed source is shifted to a paper feed source loaded with paper sheets required for the next printing job.

Control of the image forming apparatus in accordance with the above operation can restrain a possibility of printing being interrupted in the course of printing. In step S55, test paper feed is performed for only a printing job for more than 1,000 paper sheets. Therefore, test paper feed is performed for only a printing job for a large amount of paper sheets with high possibility of a paper feed source being shifted.

An explanation is now made below on a case where a printing job added with JDF that a printing job for printing a white-colored 3,300 paper sheets of A4 size is executed is received. Each of the paper sheets has paper sheets as shown in FIG. 6 describing paper sizes and number of sheets of stacked paper.

The paper feed sources which have white-colored paper sheets of A4 size thereon are three: the paper feed cassettes 4, 6 and the paper feed deck 8. The paper feed cassette 4 has paper sheets which are stacked thereon by paper feed in the last job and of which paper size and color have been already detected, therefore the paper feed sources which require to determine paper size and color with test paper feed are the paper feed cassette 6 and the paper feed deck 8.

Therefore, the first paper sheet in the printing job is fed from the paper feed deck 8 and the second paper sheet is fed from the paper feed cassette 6. The paper sensor 15 detects the paper sheet is a white colored paper sheet of A4 size and determines the paper sheets of A4 size can be properly fed from the two paper feed sources. Third to 2001st paper sheets are fed from the paper feed deck 8, thus the paper feed deck 8 has no paper sheets thereon.

The paper feed source is shifted to the paper feed cassette 4, and the 2002nd through 3001st paper sheets are fed from the paper feed cassette 4, thus the paper feed cassette 4 has no paper sheets thereon.

Next, the paper feed source is shifted to the paper feed cassette 6, and the 3002nd through 3,300th paper sheets are fed from the paper feed cassette 6 to complete the printing job.

An explanation is now made below, for example, on a case where blue-colored paper sheets of A4 size are erroneously stacked on the paper feed cassette 6. The first paper sheet for a printing job is fed, the second paper sheet is fed from the paper feed cassette 6, and the paper sensor 15 determines the size and color of each of the paper sheets. The second paper sheet is of A4 size, however, is blue, not white, thus stopping printing and displaying an error message.

In the case of no test paper feed, the error cannot be detected until the 3001st printing starts, however, by performing a test paper feed, the error can be detected at the time of a feed of the second paper sheet.

Other Embodiments

The present invention can be achieved by providing storage media for storing a program code of a software which executes a function of the embodiment to a system or an apparatus, and by making a computer (or CPU or MPU) in the system or apparatus read out and execute the program code stored in a storage media. In this case, the program code itself read out from the storage media executes a function of the embodiment described above, and the storage media for storing the program code constitutes the present invention. As the storage media for supplying the program code, for example, a floppy® disk, hard disk, optical disk, magneto-optical disk, CD-ROM, CD-R, magnetic tape, nonvolatile memory card or ROM can be used.

By executing a program code read out by the computer, the function of the above embodiment is executed and, based on an instruction of the program code, an OS (Operating System) operating on the computer executes a part or the whole of actual processing, thus achieving the function of the above embodiment by the processing.

After the program code read out from the storage medium is written in the memory provided in a function extension board inserted into the computer or a function extension unit connected to the computer, the function of the above embodiment is executed and, a CPU provided in the function extension board or function extension unit executes a part or the whole of actual processing based on an instruction of the program code, thus achieving the function of the above embodiment by the processing.

It goes without saying that the present invention can be achieved, for example, by the following: the program code of a software for executing the function of the above embodiment is distributed through the network and is stored in storing means such as a hard disk drive or memory or storage media such as CD-RW or CD-R in a system or apparatus, and a computer (or CPU or MPU) in the system or apparatus reads out and executes the program code stored in the storing means or the storage media.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority from Japanese Patent Application No. 2004-244130 filed on Aug. 24, 2004, the entire contents of which are hereby incorporated by reference herein.

What is claimed is:

1. An image forming apparatus comprising:

a generating unit adapted to generate an image forming job including image data corresponding to a plurality of pages;

an image forming unit adapted to form an image on paper;

a plurality of paper feeding units, each capable of feeding a paper used for image formation with the image forming unit;

a storing unit adapted to store multiple pieces of paper characteristic information, each of the multiple pieces of paper characteristic information indicating characteristics of a paper stacked on each of the plurality of paper feeding units;

a designating unit adapted to designate at least one paper feeding unit corresponding to paper characteristic information included in the image forming job among the plurality of paper feeding units based on the multiple pieces of paper characteristic information stored by the storing unit;

a paper characteristic detecting unit adapted to detect the characteristics of paper conveyed on a paper feed path fed from any one of the plurality of paper feeding units;

a first determining unit adapted to determine whether or not the characteristics of paper fed from the paper feeding unit designated by the designating unit correspond to the paper characteristic information included in the image forming job based on the detection result of the paper characteristic detecting unit; and a control unit adapted to control, in a case where two or more paper feeding units are designated by the designating unit, each of the two or more designated paper feeding units adapted to feed at least one paper sheet on the paper feed path so as to perform detection by the paper characteristic detection unit and then determination by the first determining unit for paper fed from the two or more designated paper feeding units before execution of the image forming job, wherein the image forming unit forms the image on paper based on the image data included in the image forming job in a case where the first determining unit determines that the characteristics of paper fed from one of the two or more designated paper feeding units correspond to the paper characteristic information included in the image forming job.

2. The image forming apparatus according to claim 1, further comprising a setting unit adapted to set the paper characteristic information for each of the plurality of paper feeding units based on an instruction by an operator of the image forming apparatus, wherein the storing unit stores the paper characteristic information set by the setting unit.

3. The image forming apparatus according to claim 1, further comprising:

a second determining unit adapted to determine the presence of stacked paper on each of the plurality of paper feeding units in accordance with the detection by the paper characteristic detection unit; and a warning unit adapted to make a warning that a paper for the image forming job should be re-supplied in a case where the second determining unit determines the absence of paper on all of the plurality of paper feeding units designated by the designating unit.

4. The image forming apparatus according to claim 3, wherein the control unit controls, in a case where the second determining unit determines the presence of paper on at least one designated paper feeding unit after the second determining unit determines the absence of paper on all of the plurality of paper feeding units designated by the designating unit, each of the at least one designated paper feeding units adapted to feed at least one paper sheet on the paper feed path so as to perform detection by the paper characteristic detecting unit and then determination by the first determining unit for paper fed from the plurality of designated paper feeding units before execution of the image forming job.

5. An image forming apparatus comprising:

a generating unit adapted to generate an image forming job including image data corresponding to a plurality of pages;

an image forming unit adapted to form an image on paper;

a plurality of paper feeding units, each capable of feeding a paper used for image formation with the image forming unit;

a first storing unit adapted to store multiple pieces of paper characteristic information, each of the multiple pieces of paper characteristic information indicating characteristics of paper stacked on each of the plurality of paper feeding units;

a designating unit adapted to designate at least one paper feeding unit corresponding to the paper characteristic information included in the image forming job among the plurality of paper feeding units based on the multiple pieces of paper characteristic information stored by the first storing unit;

a paper characteristic detecting unit adapted to detect the characteristics of paper conveyed on a paper feed path fed from any one of the plurality of paper feeding units;

a first determining unit adapted to determine whether or not the characteristics of paper fed from the paper feeding unit designated by the designating unit correspond to the paper characteristic information included in the image forming job based on the detection result of the paper characteristic detecting unit;

a second storing unit adapted to store a determination result information which indicates whether or not determination by the first determining unit is made for the characteristics of paper fed from paper feeding unit designated by the designating unit; and a control unit adapted to control, in a case where two or more paper feeding units are designated by the designating unit, each of the two or more designated paper feeding units, about which the determination result information stored in the second storing unit indicates that determination by the first determining unit is not made, adapted to feed at least one paper sheet on the paper feed path so as to perform detection by the paper characteristic detecting unit and then determination by the first determining unit for paper fed from the two or more paper feeding units, about which the determination result information is stored in the second storing unit indicates that determination by the first determining unit is not made, before execution of the image forming job, wherein the image forming unit forms the image on paper based on the image data included in the image forming job in a case where the first determining unit determines that the characteristics of paper fed from one of the two or more designated paper feeding units, about which the determination result information stored in the second storing unit indicates that determination by the first determining unit is not made, correspond to the paper characteristic information included in the image forming job.

6. The image forming apparatus according to claim 5, further comprising a second determining unit adapted to determine the presence of stacked paper on each of the plurality of paper feeding units in accordance with the detection by the paper characteristic detecting unit, wherein the second storing unit stores the determination result information which indicates that no determination is made by the first determining unit for the designated paper feeding unit in a case where the second determining unit determines the absence of paper on the designated paper feeding unit.

7. The image forming apparatus according to claim 5, further comprising a setting unit adapted to set the paper characteristic information for each of the plurality of paper feeding units based on an instruction by an operator of the image forming apparatus, wherein the storing unit stores the paper characteristic information set by the setting unit.

8. The image forming apparatus according to claim 5, further comprising:

a second determining unit adapted to determine the presence of stacked paper on each of the plurality of paper feeding units in accordance with the detection by the paper characteristic detecting unit; and a warning unit adapted to make a warning that a paper for the image forming job should be re-supplied in a case where the second determining unit determines the absence of paper on all of the plurality of paper feeding units designated by the designating unit.

9. The image forming apparatus according to claim 8, wherein the control unit controls the second determining unit in a case where the second determining unit determines the presence of paper on at least one designated paper feeding unit after the second determining unit determines the absence of paper on all of the plurality of paper feeding units designated by the designating unit, the at least one designated paper feeding unit adapted to feed at least one paper sheet on the paper feed path so as to perform detection by the paper characteristic detecting unit and then determination by the first determining unit for paper fed from the plurality of designated paper feeding units before execution of the image forming job.

10. An image forming method for forming an image on paper based on image data comprising:

a generating step of generating an image forming job including image data corresponding to a plurality of pages;

a storing step of causing a storing unit to store multiple pieces of paper characteristic information, each of the multiple pieces of paper characteristic information indicating characteristics of paper stacked on each of the plurality of paper feeding units;

a designating step of designating at least one paper feeding unit corresponding to the paper characteristic information included in the image forming job among the plurality of paper feeding units based on the multiple pieces of paper characteristic information stored by the storing unit in the storing step;

a determining step of determining whether or not the characteristics of paper fed on a paper feed path from a paper feeding unit designated in the designating step correspond to the paper characteristic information included in the image forming job based on the detection result of a detecting unit for detecting the characteristics of paper conveyed on the paper feed path; and a control step of controlling, in a case where two or more paper feeding units are designated in the designating step, each of the two or more designated paper feeding units adapted to feed at least one paper sheet on the paper feed path so as to perform detection by the paper characteristic detecting unit and then determination by the determining step for paper fed from the two or more designated paper feeding units before execution of the image forming job; and an image forming step of forming an image on paper based on the image data included in the image forming job in a case where the determining step determines that the characteristics of paper fed from one of the two or more designated paper feeding units correspond to the paper characteristic information included in the image forming job.

11. An image forming method for forming an image on paper based on image data comprising:

a generating step of generating an image forming job including image data corresponding to a plurality of pages;

a first storing step of causing a first storing unit to store multiple pieces of paper characteristic information, each of the multiple pieces of paper characteristic information indicating characteristics of paper stacked on each of the plurality of paper feeding units;

a designating step of designating at least one paper feeding unit corresponding to the paper characteristic information included in the image forming job among the plurality of paper feeding units based on the multiple pieces of paper characteristic information stored by the first storing unit in the first storing step;

a determining step of determining whether or not the characteristics of paper fed on a paper feed path from the paper feeding unit designated in the designating step correspond to the paper characteristic information included in the image forming job based on the detection result of a detecting unit for detecting the characteristic of paper conveyed on the paper feed path;

a second storing step of causing a second storing unit to store determination result information which indicates whether or not determination in the determining step is made for the characteristics of paper fed from the paper feeding unit designated in the designating step;

a controlling step of controlling, in a case where two or more paper feedings units are designated in the designating step, the two or more designated paper feeding units, about which the determination result information in the second storing unit indicates that a determination in the determining step is not made, to feed at least one paper sheet on the paper feed path so as to perform detection by the detecting unit and then determination in the determining step for paper fed from the two or more paper feeding units, about which the determination result information stored in the second storing unit indicates that a determination in the determining unit is not made, before execution of the image forming job; and an image forming step of forming an image on paper based on the image data included in the image forming job in a case where the determining step determines that the characteristic of paper fed from one of the two or more designated paper feeding units, about which the determination result information stored in the second storing unit indicates that a determination in the determining unit is not made, correspond to the paper characteristic information included in the image forming job.

* * * * *